US006746301B1

(12) United States Patent
Lund et al.

(10) Patent No.: US 6,746,301 B1
(45) Date of Patent: Jun. 8, 2004

(54) BOUNCING AND DANCING TOY FIGURE

(75) Inventors: Bruce D. Lund, Chicago, IL (US); Michael Starrick, Maywood, IL (US); Sunil Moothedath, Chicago, IL (US)

(73) Assignee: Lund and Company Invention, LLC, Chicago, IL (US)

( * ) Notice: Subject to any disclaimer, the term of this patent is extended or adjusted under 35 U.S.C. 154(b) by 0 days.

(21) Appl. No.: 10/641,234

(22) Filed: Aug. 15, 2003

(51) Int. Cl.[7] ..... A63H 11/00
(52) U.S. Cl. ..... 446/298; 446/322; 446/353
(58) Field of Search ..... 446/175, 297, 446/298, 322, 323, 325, 330, 352, 353, 354, 369, 376, 383

(56) References Cited

U.S. PATENT DOCUMENTS

| | | | | |
|---|---|---|---|---|
| 4,608,026 A | * | 8/1986 | Newton et al. | 446/330 |
| 5,374,216 A | * | 12/1994 | Jung et al. | 446/175 |
| 6,322,420 B1 | * | 11/2001 | Daniellian | 446/300 |
| 6,375,536 B1 | * | 4/2002 | Yang | 446/353 |
| 6,645,036 B1 | * | 11/2003 | Lund et al. | 446/355 |

* cited by examiner

*Primary Examiner*—Jacob K. Ackun, Jr.

(57) ABSTRACT

A toy character having a body portion and a pair of legs operated by motor operated linkages that are controlled by a microprocessor. The microprocessor functions to move the legs in unison between sitting and standing positions or move the legs in opposite directions. The character thus functions to bounce and dance.

18 Claims, 9 Drawing Sheets

BOUNCING AND DANCING TOY FIGURE

BACKGROUND OF THE INVENTION

Toy figures have always been the mainstay of toys for young children. There exist figures that walk, crawl and speak in response to a child touching or squeezing various parts of the figure. There is a continual need for new and novel features, particularly, such as having the figure bounce and/or dance when activated.

SUMMARY OF THE INVENTION

There is herein described and illustrated a unique animated figure such as a toy tiger that can be programmed to repeatedly move between a standing and sitting position by moving the legs in unison up and down to effectively bounce. In addition to bouncing, the figure is designed so that the legs can be moved in alternate directions while the toy animated figure pivots about its tail to create the effect of a dancing figure.

To accomplish these movements of the toy figure there are provided motor operated assemblies controlled by a switch actuated microprocessor to provide for particular movements of the toy figure's legs. The legs are pivotally connected to the body portions of the figure. To bring about the bouncing action the legs are moved in unison repeatedly between sitting and standing positions. Specifically, a bi-directional motor driven gear assembly for one of the legs is activated, which leg is interconnected to the other leg by a rod so that when the driven leg is moved upward both legs are moved up in unison and when the motor reverses both legs are moved downward together. When this is repeated it results in a bouncing action for the toy figure. If it is desired to provide a dancing motion for the figure, the motor operated gear assemblies are operated to repeatedly move the legs in opposite directions relative to each other with the result that the figure pivots from side to side about its tail which gives the illusion of a dancing figure.

In order to effectuate a dancing motion of the figure, the center of the rod member interconnecting the two legs is held fixed at an intermediate location to create a pivot point with the result that the driving movement of the driven leg in one direction will result in the movement of the rod about the fixed pivot point to drive the other leg in the opposite direction relative to the driven leg. The figure is provided with a rigid tail portion that sits on the ground and when the legs are repeatedly moved in opposite directions relative to each other, the figure tilts from side to side about the tail portion to effectively create a dancing motion of the figure.

The details of the toy figure comprising applicant's invention is illustrated and described in detail but in order to better understand the function and interaction of the various components we provide the following general description.

The toy figure is provided with a bi-directional motor actuated gear mechanisms and linkages that are controlled by a battery operated, preprogrammed microprocessor that is signaled by a switch in an arm of the figure. Actuation of the microprocessor operates a motor to drive a gear mechanism to move the legs relative to the body portion. As aforementioned, when the motor is operated in one direction and then in a reverse direction the rod connecting the two legs is moved to move the legs up and down in unison about the body portion. Repeated bi-directional operation of the motor creates the bouncing action.

In order to move the legs in opposite directions to provide the dancing action a second motor operated mechanism is employed to effectuate a different movement of the rod interconnecting the legs. To this end the intermediate portion of the rod is restrained against movement in the vertical plane and secured in its horizontal position. The mid-point of the rod then functions as a pivot point about which the rod moves. Thus, when the driven leg is moved by its associated motor driven gear assembly the rod pivots about the restrained intermediate portion to move the other leg in the opposite direction. Suitable means are provided to limit the movement of the legs. Briefly, the second motor operated mechanism includes a gripping pawl assembly that when actuated the intermediate portion of the rod is held against a stop member to limit the rod to a pivotal movement about the restrained portion.

As an example, the operation of the aforementioned motor, gear and linkage assemblies are effected by a microprocessor to sequence the operation of the figure to give it initially a bouncing effect by repeatedly moving the legs upwardly to seat the figure and then downwardly to have it stand up. The microprocessor can then be sequenced to operate the second motor mechanism whereby the rod connecting the two legs is restrained in an intermediate position so the rod can only move in a horizontal path with the result that when one leg moves the other leg is moved in the opposite direction. Other mechanisms are provided to assist in the standing of the figure, provide a centering action of the rod and to assist in the moving of the legs in opposite directions and for emitting messages through a speaker when desired.

To have a better understanding of the invention reference is made to the following detailed description of the invention and embodiments thereof, from the claims and from the accompanying drawings in which:

DETAILED DESCRIPTION OF THE DRAWINGS

Figure 1:
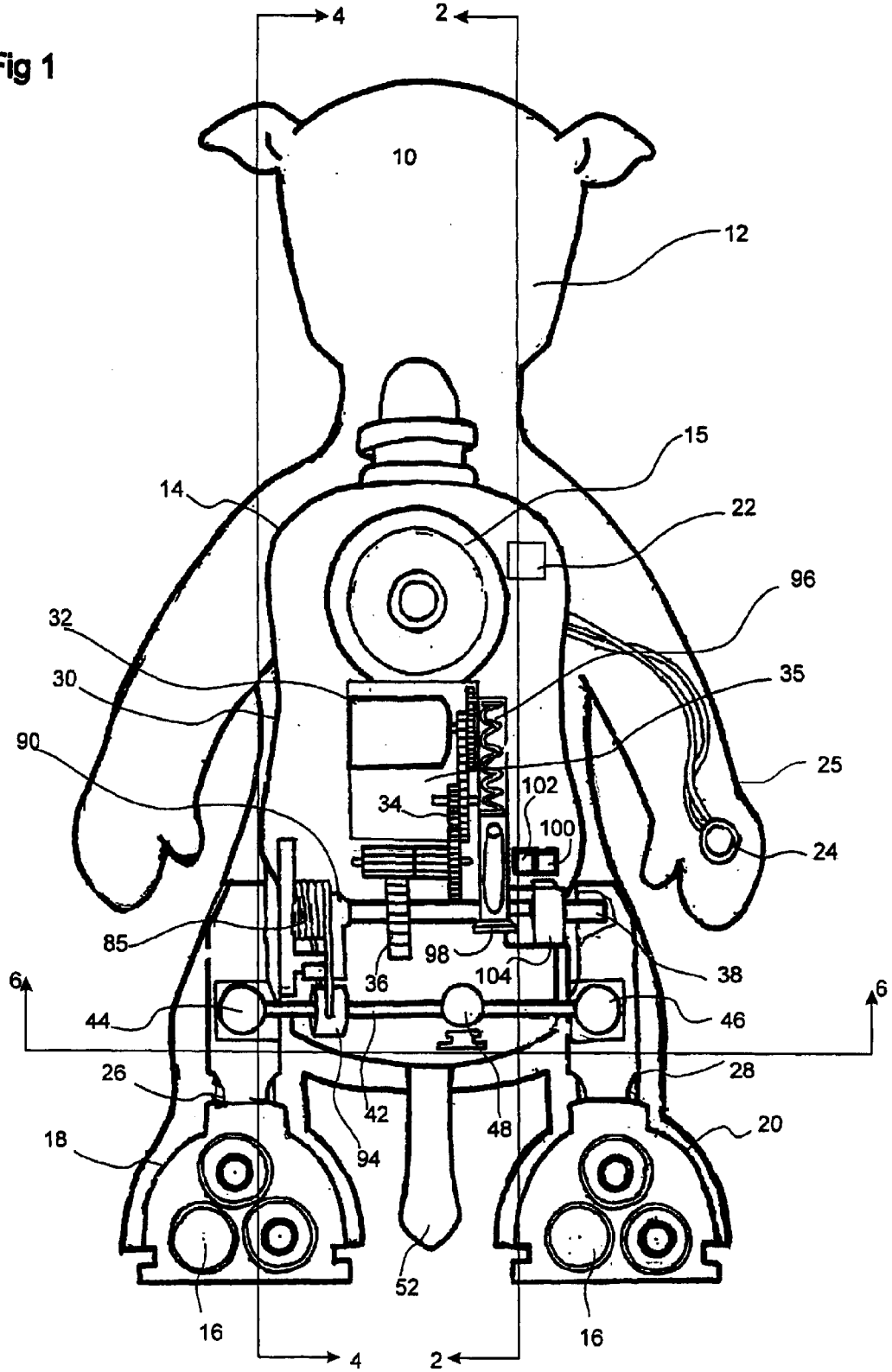
FIG. 1 is a front view of the toy character exposing various internal components such as the motor, gear and linkage mechanisms, as well as the speaker, power source, etc. that will be described in detail hereinafter.

Referring first to FIG. 1 there is shown a toy character 10 in the form of an animal such as a bear which has a plush fabric skin 12 disposed over a plastic case 14. The toy character 10 includes a speaker 15 in case 14 and batteries 16 located in both its right 18 and left foot 20, which batteries are used to supply power to a microprocessor 22 that is controlled by a momentary contact switch 24 located in left hand 25. The right leg 26 and left leg 28 are pivotally connected to the body portion 30 of the character 10 in a conventional manner and are free to be moved relative thereto. The movement of the legs 26, 28 are controlled by a gear drive mechanism operated by a bi-directional motor 32. The drive mechanism between the motor and the left leg consists of a gear mechanism 34 in a gear box 35 which ultimately drives a gear 36 located on the shaft 38 that is suitably connected to the left leg 28 to move the left leg 28 in opposite directions as directed by the motor 32. The legs 26, 28 are connected by a rod assembly 40 disposed below the shaft 38 and depending on the operation of the rod assembly 40 the legs 26, 28 will be moved in the same or in opposite directions relative to the body portion 30. The rod assembly 40 connecting the two legs 26, 28 for operating the legs in unison or in opposite directions consists of a rod 42 that has ball portions 44, 46 located at their ends, which ball portions are secured into the right and left legs as shown. Connected to the mid-portion of the rod 42 is a ball member 48, about which more will be explained hereinafter.

Figure 13A:
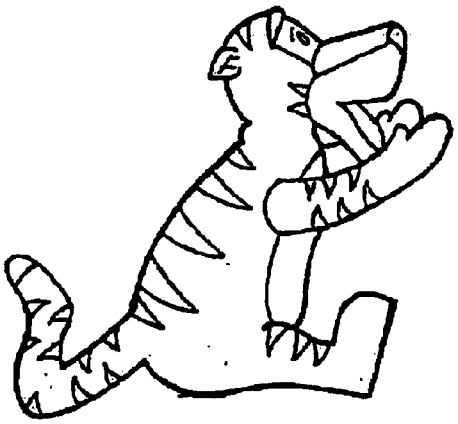
FIG. 13A shows the figure in a sitting position.
Figure 13B:
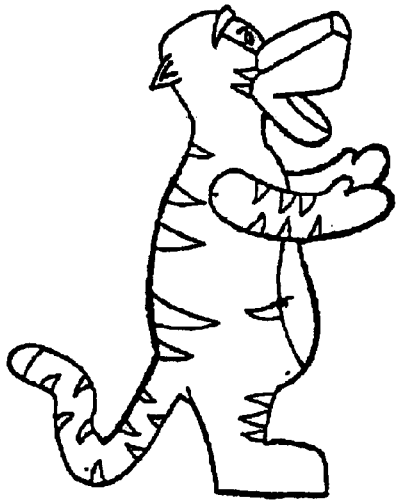
FIG. 13B shows the figure in a standing position.

In the position shown in FIG. 1 the rod 42 and the legs 26,28 connected thereto are free to move up and down in accordance with the rotation of the shaft 38 by the gear 36. Specifically the shaft 38 pivots the left leg 28 in an upward direction, and the rod 42 is free to move the right leg 26 in unison with the left leg. The bi-directional motor 32 initially operates the gear mechanism 34 and drive shaft 38 to move the rod 42 and both the right and left legs upward to a sitting position and then the motor 32 reverses itself and moves the right and left legs in the reverse direction. When this repeated action occurs the body portion is moved up and down and the bouncing action is achieved as shown in FIGS. 13A and 13B.

Figure 12A:
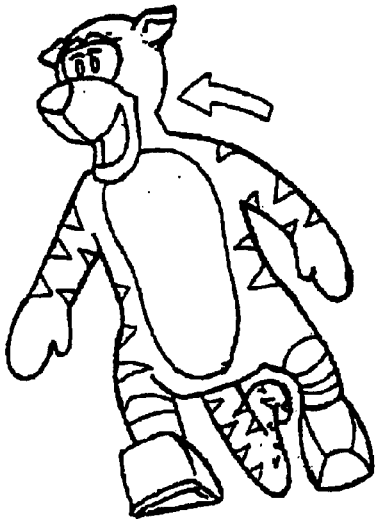
FIGS. 12A and 12B illustrate the figure in its side-to-side or dancing position.
Figure 12B:
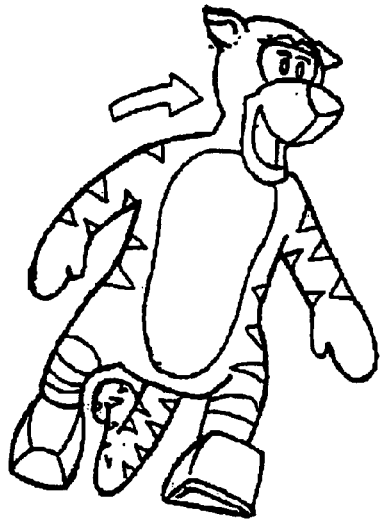

When the microprocessor 22 functions to create the "dancing" action the legs are set to move in the opposite direction relative to each other. This results in the teetering of the character in one direction and then the other about the tail 52 as shown in FIGS. 12A and 12B. To move the legs in opposite directions the rod assembly 40 must have a different mode of operation. To this end there is provided a clamping mechanism to clamp the ball member 48 located at the center point of the rod 42 between a stop tab 54 and a midpoint retaining pawl assembly 56 as shown in FIG. 6. The details of the pawl assembly 56 are shown in FIGS. 5A and 5B.

Figure 5A:
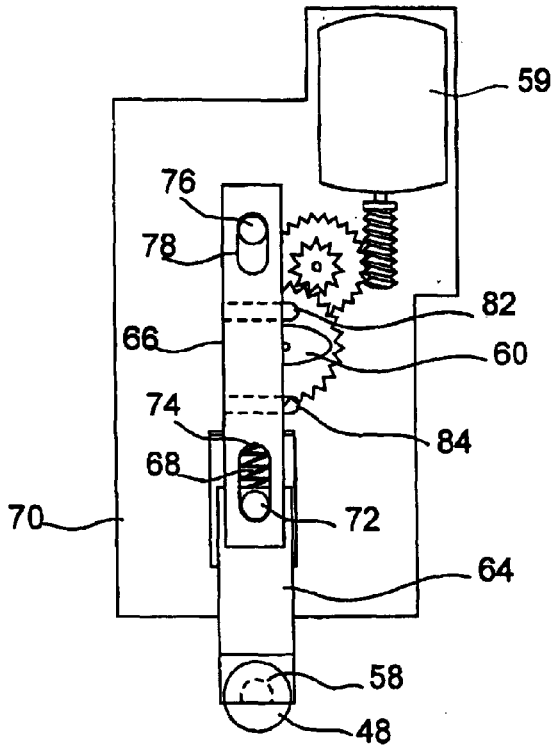
FIG. 5A is a schematic view showing the pawl restricting rod mechanism in its lowered position restraining the intermediate portion of the rod connecting the legs.
Figure 5B:
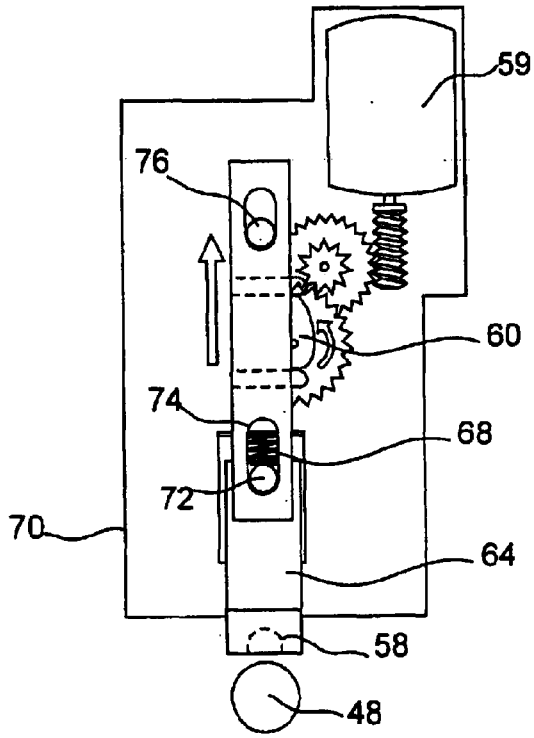
FIG. 5B is a figure similar to FIG. 5A but showing the pawl restricting rod mechanism out of contact with the rod.
Figure 6:
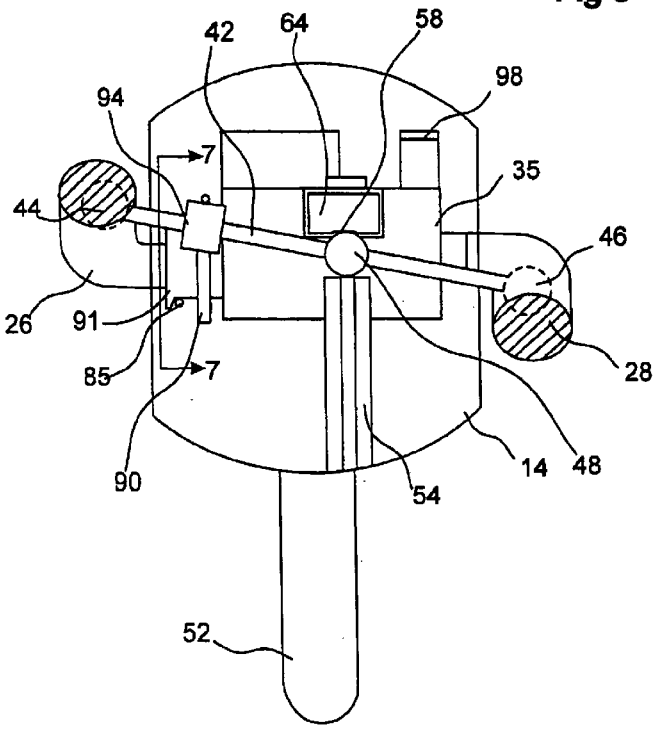
FIG. 6 is a cross-sectional view taken along line 6—6 of FIG. 1 and shows the intermediate portion of the rod connecting the legs being retained in a fixed position and the legs moved in an opposite direction relative to each other along with the positions of the various components thereof.

The clamping portion 58 of the pawl assembly 56 is moved to the lowered position as shown in FIG. 5A to secure the ball portion 48 of the rod assembly 40 in position. When the clamping portion 58 is moved upward, as shown in FIG. 5B, the rod assembly 40 along with both legs 26, 28 are free to be moved in unison between sitting and standing positions.

Figure 8:
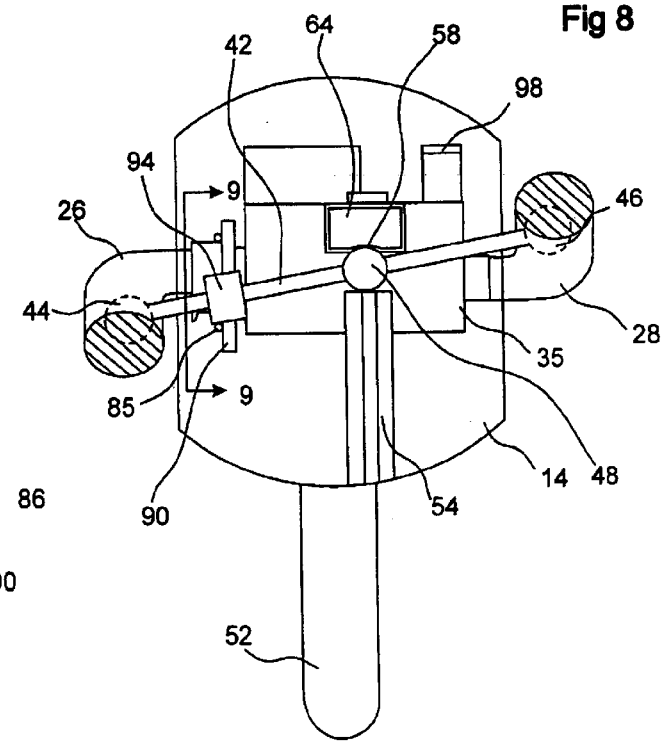
FIG. 8 is a view similar to FIG. 6 but showing the legs in the opposite position from that shown in FIG. 6 wherein the left leg is in the forwardly extending position and the right leg is in the rearwardly extending position.

As shown in FIG. 5A, the clamping and unclamping of the ball member 48 is accomplished by a second motor 59 which moves a cam gear assembly 60 to allow the pawl assembly 56 to be moved downwardly to retain the ball member 48 and associated rod 42 to form a pivot point 62 for the rod as shown in FIGS. 6 and 8. The pawl assembly 56 includes two relatively moveable members 64, 66. As illustrated in FIG. 5A, the bottom member 64 is biased downwardly into engagement with the ball member 48 to clamp the ball member 48 against the stop tab 54 (see FIG. 6) to create the pivot point 62. The cam gear assembly is operated to move member 66 up. This raises member 66 to unlatch ball 48. The pin 72 is limited in its downward movement by being located in slot 74 located in upper member 66. The upper member 66 is limited in its downward movement by a pin 76 extending from plate 70 into slot 78 of member 66. Operating on the upper pawl member 66 is the cam gear assembly that is moved by the motor 59 between the position shown in FIG. 5A wherein the pawl member 66 is in its lower position and the clamping portion 58 is in engagement with the ball element 48 and the position shown in FIG. 5B wherein the cam gear assembly 60 is located between the tabs 82,84 extending outwardly from plate 66 to raise the lower pawl member 64 against the biasing of spring 68. This acts to disengage the pawl member 58 from the ball member 48 to free the rod 42 from being restrained at the pivot point 62 and allow the legs 26,28 to move in unison when shaft 38 is driven by the motor 32. Referring again to FIG. 6 there is a cross-section view with the legs broken away showing the position of the rod assembly 40 with the ball 48 retained in position between the stop tab 54 and the retaining pawl member 64 to form pivot 62. Thus when the left leg 28 moves rearwardly the rod 42 will pivot in the horizontal plane about the ball pivot 62 to move the right leg 26 forwardly.

Figure 7:
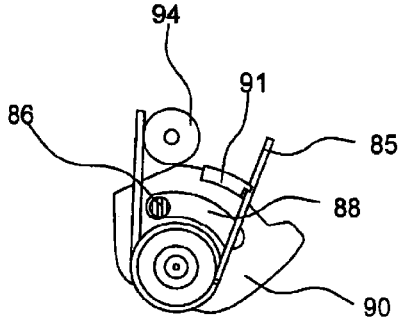
FIG. 7 is a view taken along line 7—7 of FIG. 6 showing the position of the centering torsion spring and drive plate when the left leg is in a rearward position and the right leg is disposed in a forward direction.
Figure 9:
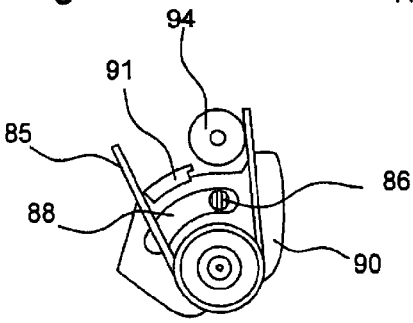
FIG. 9 is a view taken along line 9—9 of FIG. 8 showing the position of the centering torsion spring and drive plate when the right leg is moved forward and the left leg is in a rearward position in the form of an animal such as a bear.

The movement of the legs in the forward and rearward positions are driven against a centering torsion spring 85 which is placed loosely on drive plate 90 which is driven by and rotates with drive shaft 38. The movement of the legs 26,28 is restricted by the provision of a pin 86 extending from the right leg 26 into a slot 88 in the drive plate 90. The active ends of centering torsion spring 85 are in contact with spring collar 94 on rod 42 and an arm 91 extending from the drive plate 90. When the right leg 26 in FIG. 6 is moved in a forward direction the collar 94 located on the rod 42 is moved against a free end of the torsion spring 85 until the pin 86 reaches the end of slot 88 as shown in FIG. 7. The other end of the torsion spring 85 is held in position by arm 91 on plate 90 to increase the reactive force of the torsion spring 85. FIG. 8 shows the left leg moving forward. The torsion spring aids in reversing the action of the legs until they get to the neutra/centered position. As seen in FIG. 9 the movement of leg 26 in the rearward direction is restricted by the pin 86 reaching the other end of slot 88. Thus the "dancing" action is accomplished. This reversing action continues until the motor 32 stops and/or the microprocessor acts to reverse motor 59 to remove the retaining pawl from its clamping position.

Figure 10:
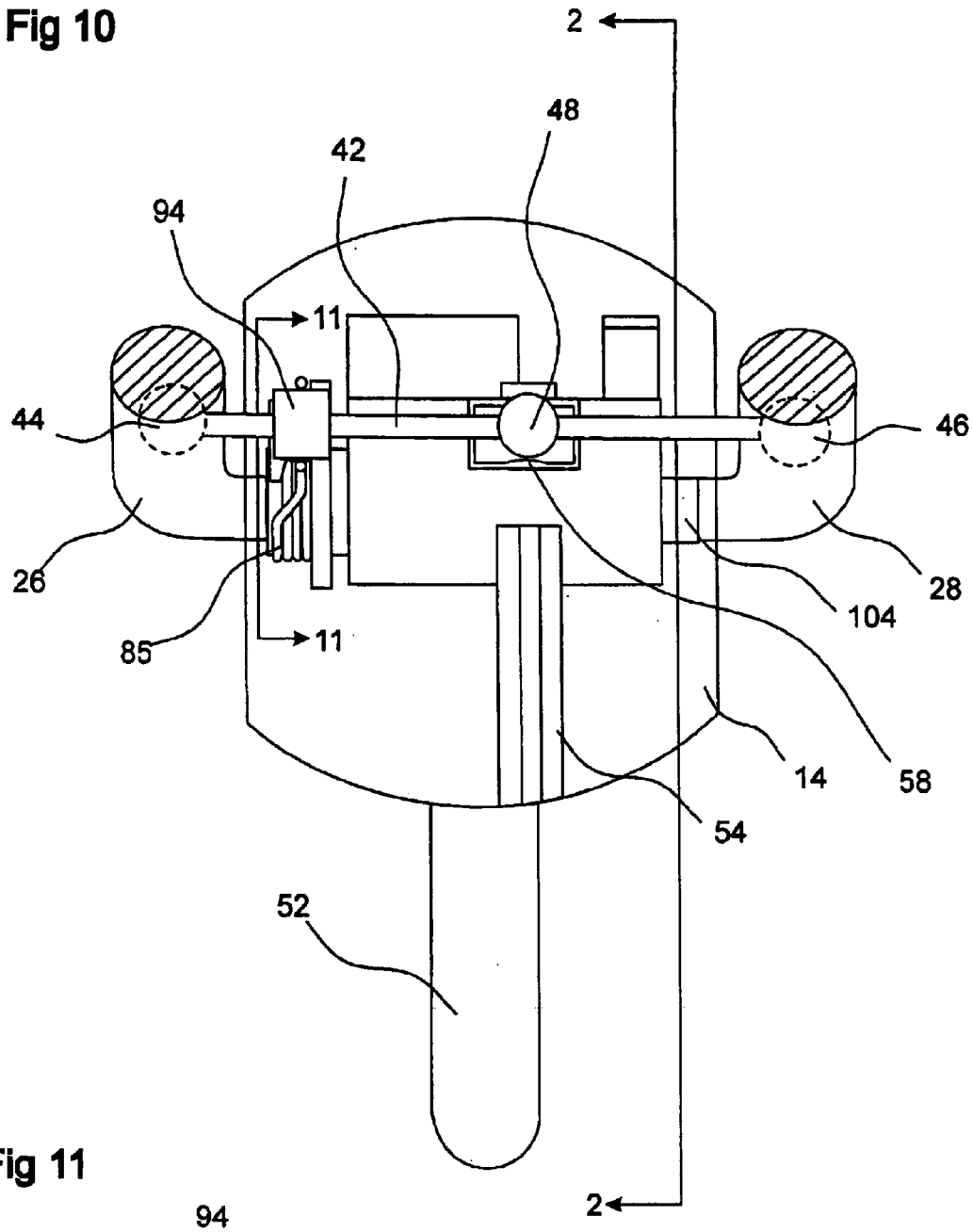
FIG. 10 is a bottom view of the toy character illustrated along line 6—6 wherein the locking pawl has released its engagement with the rod and both logs, drive plate and centering torsion spring can be moved in unison to raise and lower the legs.
Figure 11:
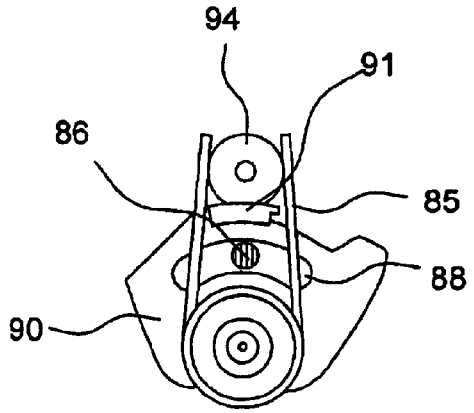
FIG. 11 is a view taken along line 11—11 showing the position of the plate, torsion spring, etc. when the mechanism illustrated is in the position shown in FIG. 10.

FIG. 10 is a view taken along line 6—6 of FIG. 1 with the legs 26,28, rod 42 and centering torsion spring moved in unison in an arc from stop tab 54 around the rotational axis of drive shaft 38.

Figure 2:
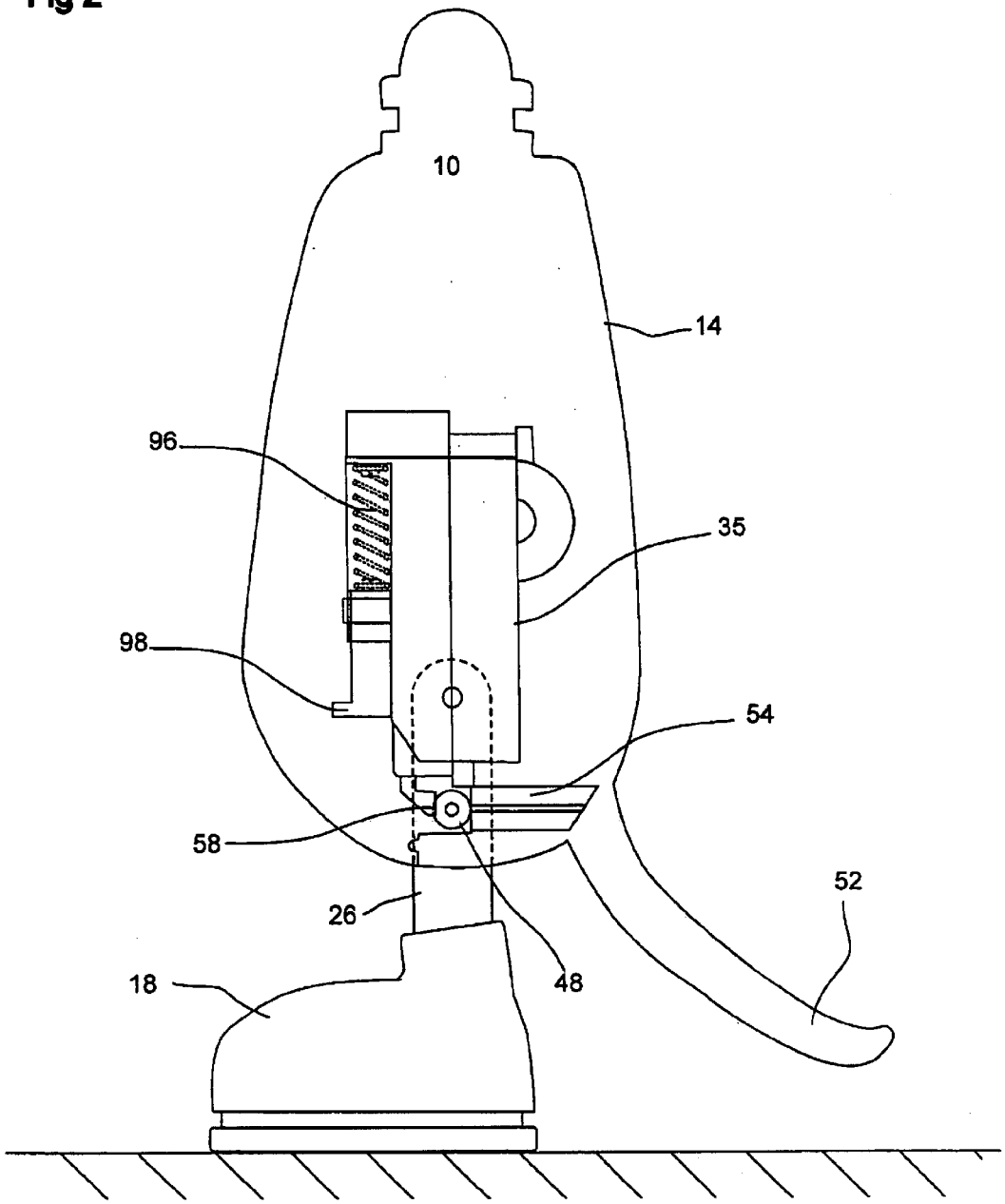
FIG. 2 is a view taken along line 2—2 of FIG. 1 in which the character is shown in the standing position with the mid-point of the connecting rod controlling the interaction of the legs being restrained so the movement of the driving leg in one direction will result in moving the other leg in the opposite direction.
Figure 3:
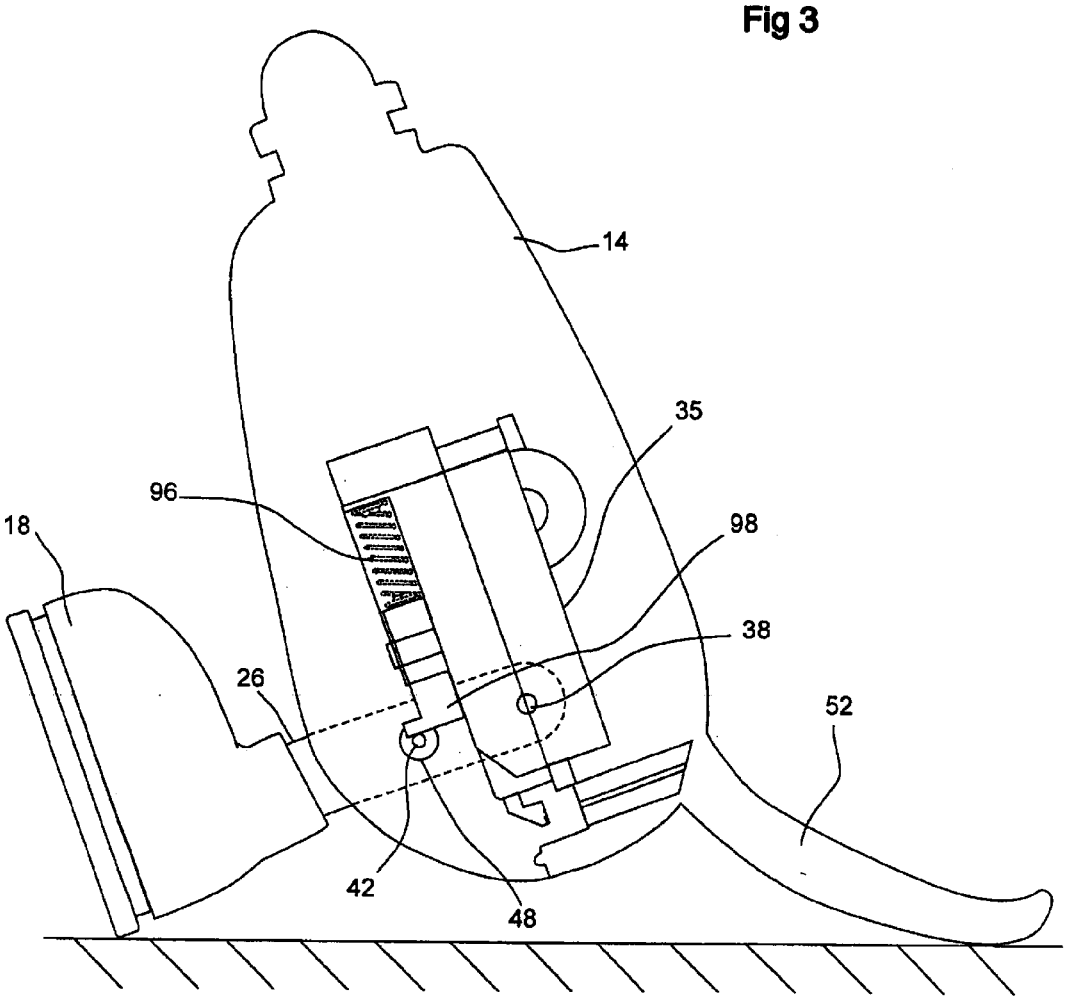
FIG. 3 shows the toy character of FIG. 1 when in a sitting position with a cross-section also taken at line 2—2 of FIG. 1.
Figure 4:
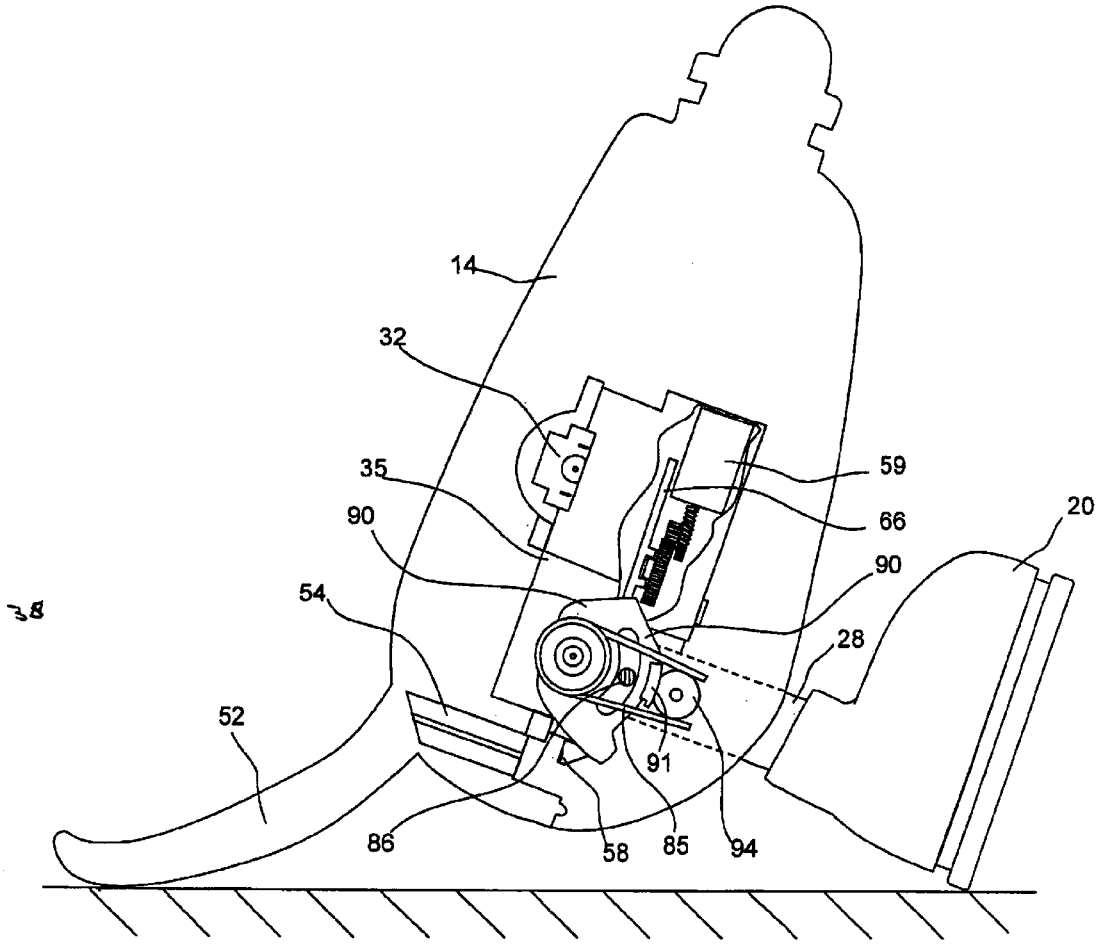
FIG. 4 is the toy character of FIG. 1 taken along line 4—4 of FIG. 1 but shown at the top of its bounce position with the legs in the upwardly extending position and the figure resting on its tail portion.

When the legs are moved in unison to accomplish the bouncing action there is provided a spring assist assembly that includes a spring 96 and biased piston 98 that is engaged to help return the legs to their standing position. This is best shown in FIG. 2 and FIG. 3. In FIG. 2 the right leg is shown in the down position with the piston 98 and spring 96 fully extended. In FIG. 3 the legs 26,28 have been raised to where the rod 42 moves the piston 98 up against the spring 96 that results in a compressive force that acts against the legs to assist in the downward action when the legs are moved downwardly by the reversing motor 32 to return the figure to the standing position.

It remains to note that the figure is provided with a standing switch 100 and a sitting switch 102 that responds to the relative position of the legs to the torso through a cam assembly 104 which feeds back such information to the microprocessor when the figure is in a particular position so the microprocessor will have the figure stand, sit, dance side to side and bounce up and down as preprogrammed.

Figure 14:
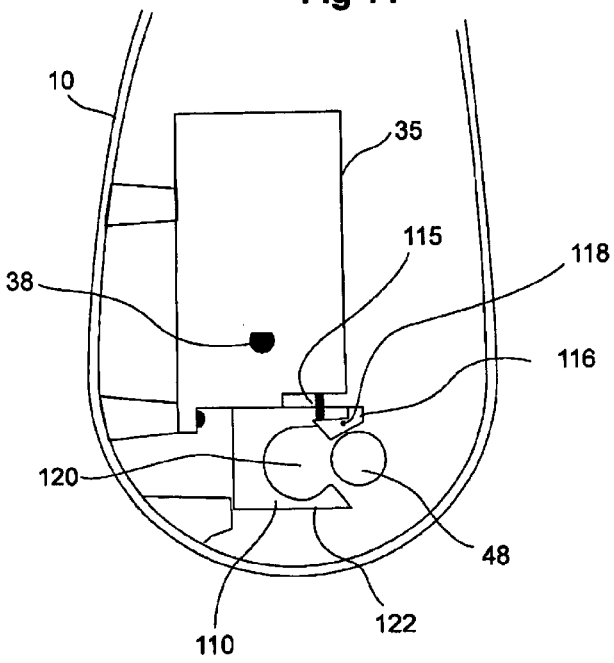
FIG. 14 illustrates one embodiment of a non-motorized latch mechanism for retaining the pivot ball in position to effectuate the dancing action of the figure.
Figure 15:
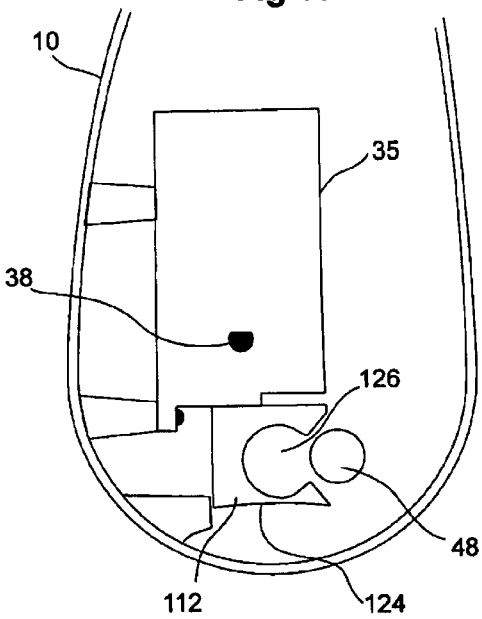
FIG. 15 is a second embodiment of the non-motorized latch mechanism.
Figure 16:
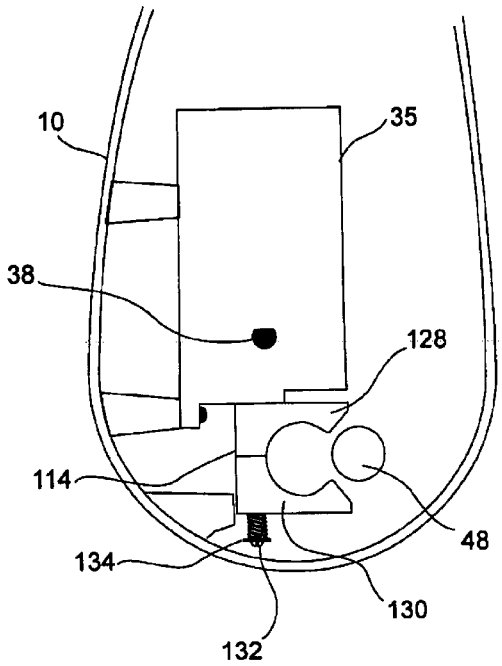
FIG. 16 is a third embodiment of the non-motorized latch mechanism.

There has been illustrated and described with respect to FIGS. 1–11 a motorized mechanism for securing the ball 48 in position to bring about a pivoting action of the rod 42 and thus a dancing movement of the toy character 10. In place of the motorized latching mechanism of FIGS. 1–11 a non-motorized latching mechanism can be provided, several embodiments of which are shown in FIGS. 14–16. Essentially, the microprocessor is programmed so that when a dancing action is to occur an additional force is applied to the rod 42 to move the ball 48 into a latched position within the ball-shaped recesses formed by latch mechanisms 110, 112 and 114.

The latch mechanism 110 secured to gear box 35 includes a spring 115 biasing latch member 116 that is pivoted at 118 and when the ball 48 is biased against the latch member 116 it moves into recess 120 in rigid member 122. After the ball 48 is in place it stays in recess 120 until it is pulled outwardly by a preprogrammed force acting on rod 42 to return the figure to a bouncing mode in which the legs will again move in unison.

Latch mechanism 112 is similar to latch mechanism 110 except that the latch member 124 is flexible and the flexibility thereof controls the movement of the ball 48 into and out of recess 126.

Latch mechanism 114 is also similar to latch mechanism 110 but instead of the moving latch member 116 the latch mechanism is in two parts 128, 130. Upper part 128 is secured to gear box 35 and the lower moving part 130 is biased by spring 132 acting between a fixed member 134 and moving member 130 to provide the force controlling the movement of ball 48 like the spring 115 in FIG. 14 and the resiliency of the flexible member 124 in FIG. 15.

It is intended to cover by the appended claims all improvements that fall within the true spirit and scope of the invention.

What is claimed:

1. A toy character assembly comprising a body portion, a pair of legs movably connected to said body portion, a first motor driven assembly for moving one of said legs, linkage means connecting said legs, control means for regulating the action of said linkage means, a microprocessor for controlling the operation of said motor driven assembly, linkage means and control means and switch means for actuating said microprocessor, and a power source for said motor, microprocessor and switch means whereby when the switch means is activated the microprocessor can function to move said legs in unison between sitting and standing positions or move said legs in opposite directions.

2. A toy character assembly as set forth in claim 1 in which the character is provided with a rigid tail and the microprocessor is programmed to operate said control means to move said linkage means to move the legs in opposite directions relative to said body portion to provide a dancing movement of the toy character about said tail.

3. A toy character assembly as set forth in claim 1 in which the legs are pivotally connected at one end to the body portion and each includes a foot portion at its other end, the linkage means includes a rod member connecting the two legs whereby when said leg is motor driven in one direction the other leg is moved in unison therewith and will move the legs between a sitting and standing position to provide a bouncing effect.

4. A toy character assembly as set forth in claim 2 in which the legs are pivotally connected at one end to the body portion and each includes a foot portion at its other end, the linkage means includes a rod connecting the two legs and having an intermediate portion and the control means for regulating the action of said linkage means includes means for restraining the movement of the intermediate portion of said rod whereby when one leg is motor driven in one direction the other leg is moved in the opposite direction by pivoting the rod about said restraining means to provide the dancing movement of the body portion about said tail.

5. A toy character assembly as set forth in claim 4 in which the means for restraining the movement of the intermediate portion of said rod includes a motor driven locking pawl assembly including a locking pawl restraining the intermediate portion of said rod against a stop member located in said body portion adjacent said intermediate rod portion.

6. A toy character assembly as set forth in claim 3 in which the rod member connecting the two legs has ball-shaped end portions embedded in each of said legs.

7. A toy character assembly as set forth in claim 5 in which the rod member connecting the two legs has ball-shaped end portions embedded in each of said legs and an intermediate ball-shaped portion that is captured between said stop member and restraining pawl when the motor driven locking pawl assembly is actuated to bring about alternate movement of said legs to create the dancing movement of said character about said tail.

8. A toy character assembly as set forth in claim 5 in which the motor driven pawl assembly includes a motor gear assembly, a cam gear that is operated by said motor gear assembly to move the pawl assembly out of engagement with the intermediate portion of said rod to permit the legs to be moved in unison and the pawl assembly comprises two interconnected members, one which is connected to the cam gear and the other includes a locking pawl, and spring means biasing said locking pawl into engagement with the intermediate portion of said rod whereby when the motor is operated to drive the cam gear in one direction the locking pawl is moved out of engagement with said rod and when the motor is operated to move the cam gear in the opposite direction the spring means biases the locking pawl into engagement with the rod to restrain the intermediate portion against movement to create a pivot point so the legs will be moved in opposite directions when one leg is driven by the first motor driven assembly.

9. A toy character assembly as set forth in claim 3 in which the body portion includes a spring bias plunger means positioned to be contacted and compressed by said rod when moved from the standing to the sitting position during the bouncing action of the assembly whereby when the motor driven assembly is reversed to move the legs from the sitting to the standing position the spring biased plunger will assist in the movement of said legs to the standing position.

10. A toy character as set forth in claim 1, wherein the toy character assembly includes a pair of arms having hands attached thereto and the switch means for actuating said microprocessor is located in one of said hands whereby the pressing of said one hand will activate the microprocessor to go through the motions programmed into the microprocessor.

11. A toy character as set forth in claim 10 in which there is a speaker operated by said power source that functions to make predetermined audible sounds by said microprocessor.

12. A toy character assembly as set forth in claim 4 in which the motor driven assembly includes a bi-directional motor, a gear assembly including a gear connected to a drive shaft secured at one end to one of said legs, a torsion spring disposed about the other end of said shaft, a roller secured to said rod and the ends of the torsion spring are positioned to be engaged by said roller whereby when the rod is moved in one direction to move a leg in said one direction, the torsion spring assists in moving said one leg in the opposite direction when the rod is moved in said opposite direction to reverse the direction of movement of said legs.

13. A toy character assembly as set forth in claim 12 in which there is a plate secured to and rotates with said drive shaft, which plate includes a section in connection with one end of said torsion spring and the other end of said torsion spring is in contact with said roller whereby the reactive force is increased when the leg is moved in one direction to move the leg in the opposite direction.

14. A toy character assembly as set forth in claim 13 in which said plate defines a slot and one of said legs includes a pin extending into said slot whereby the movement of said one leg in opposite directions is limited by the movement of said pin in said slot.

15. A toy character assembly as set forth in claim 4 in which the means for restraining the movement of the intermediate portion of said rod includes a latching mechanism located in said body portion adjacent said intermediate rod portion.

16. A toy character assembly as set forth in claim 15 in which the rod portion includes an intermediate ball-shaped portion and the latching mechanism comprises a first member defining a recess for receiving said ball-shaped member and a spring biased latch which controls the movement of the ball-shaped member relative to said recess in response to the preprogrammed operation of said microprocessor.

17. A toy character as set forth in claim 15 in which the rod portion includes an intermediate ball-shaped member and the latching mechanism consists of a flexible c-shaped member for receiving said ball-shaped member and the movement of said ball-shaped member relative to said flexible c-shaped member is controlled by the preprogrammed operation of said microprocessor.

18. A toy character as set forth in claim 15 in which the rod portion includes an intermediate ball-shaped member and the latching mechanism consists of a two-piece member defining a recess for receiving the intermediate ball-shaped member, one of said members is secured to said body portion and the other of said members is resiliently biased against said first member whereby when the microprocessor is programmed to institute a dancing movement of the character's legs a force is imposed on said rod to force the ball-shaped member into the recess defined by said latching mechanism against the action of said spring and when the legs are to be moved into a bouncing mode the ball-shaped member is pulled out of said recess against the action of said spring.

* * * * *